US012655621B2

(12) United States Patent
Panaccio et al.

(10) Patent No.: US 12,655,621 B2
(45) Date of Patent: Jun. 16, 2026

(54) LEACHING CHAMBER WITH INTEGRATED DISTRIBUTION CHANNEL

(71) Applicant: PREMIER TECH EAU ET ENVIRONNEMENT LTÉE, Rivière-du-Loup (CA)

(72) Inventors: Béatrice Panaccio, St-André-de-Kamouraska (CA); Colin Côté, Rivière-du-Loup (CA); Emmanuel Lecat, Rivière-du-Loup (CA); Jean-Pierre Daigle, Rivière-du-Loup (CA); Samuel Lavoie, Rivière-du-Loup (CA); Raphaëlle Morin-Blais, Cacouna (CA); Nicolas Robitaille, Rivière-du-Loup (CA)

(73) Assignee: PREMIER TECH EAU ET ENVIRONNEMENT LTÉE, Rivière-du-Loup (CA)

( * ) Notice: Subject to any disclaimer, the term of this patent is extended or adjusted under 35 U.S.C. 154(b) by 0 days.

(21) Appl. No.: 19/147,289

(22) PCT Filed: Jan. 12, 2024

(86) PCT No.: PCT/CA2024/050034
§ 371 (c)(1),
(2) Date: Jul. 10, 2025

(87) PCT Pub. No.: WO2024/148439
PCT Pub. Date: Jul. 18, 2024

(65) Prior Publication Data

US 2026/0110165 A1 Apr. 23, 2026

Related U.S. Application Data

(60) Provisional application No. 63/438,877, filed on Jan. 13, 2023.

(51) Int. Cl.
*E03F 1/00* (2006.01)

(52) U.S. Cl.
CPC ..... *E03F 1/002* (2013.01)

(58) Field of Classification Search
CPC ..... E01F 1/002
See application file for complete search history.

(56) References Cited

U.S. PATENT DOCUMENTS 3,645,100 A 2/1972 La Monica
4,192,628 A * 3/1980 Gorman ..... E03F 1/003 405/45

(Continued)

FOREIGN PATENT DOCUMENTS

CA 2535017 C 4/2005
EP 0780524 A1 6/1997

*Primary Examiner* — Kyle Armstrong
(74) *Attorney, Agent, or Firm* — SMART & BIGGAR LP

(57) ABSTRACT

The present application relates to leaching chambers, for receiving, collecting and dispersing water underground, leaching assemblies and kits comprising the same, and methods and uses thereof. More particularly, provided is a leaching chamber comprising: an elongated body having a top wall, two opposing sidewalls extending downwardly from each side, said elongated body defining an internal chamber having an open bottom to allow for discharge of the water; and a distribution channel formed integrally within the top wall and configured for receiving and dispersing the water, said distribution channel being formed longitudinally and being perforated for draining the water into the internal chamber, wherein said elongated body and said distribution channel form a single unitary piece.

20 Claims, 18 Drawing Sheets

(56) References Cited

U.S. PATENT DOCUMENTS

| | | | | |
|---|---|---|---|---|
| 5,017,041 | A | 5/1991 | Nichols | |
| 5,156,488 | A | 10/1992 | Nichols | |
| 5,890,838 | A * | 4/1999 | Moore, Jr. | E03F 1/003 405/49 |
| 6,361,248 | B1 * | 3/2002 | Maestro | E03F 1/003 405/48 |
| 7,413,381 | B1 * | 8/2008 | Bracone, Jr. | E03F 1/003 405/45 |
| 8,337,119 | B2 | 12/2012 | Burnes et al. | |
| 10,472,813 | B1 | 11/2019 | Sipaila | |
| 2007/0231071 | A1 | 10/2007 | Brochu et al. | |
| 2008/0240859 | A1 | 10/2008 | Sipaila | |
| 2015/0322638 | A1 | 11/2015 | Suazo | |
| 2019/0316340 | A1 * | 10/2019 | Holbrook | E03F 1/002 |

* cited by examiner

LEACHING CHAMBER WITH INTEGRATED DISTRIBUTION CHANNEL

CROSS REFERENCE TO RELATED APPLICATION

The present application is a 35 USC 371 national stage entry of PCT/CA2024/050034 filed on Jan. 12, 2024, and which claims the benefit of priority of U.S. Provisional Patent Application No. 63/438,877, which was filed on Jan. 13, 2023. These documents are hereby incorporated herein by reference in their entirety.

FIELD

The present application is in the field of water conveyance and/or draining. More particularly, the present application relates to leaching chambers, for receiving, collecting and dispersing water underground.

BACKGROUND

Molded plastic leaching chambers are widely used for discharging wastewater, treated water or stormwater onto gravel, sand or native soil so that it can reach the groundwater through infiltration, optionally after treatment by the sand or the soil when required. Typically, these chambers are disposed on a receiving surface, either into cut-in-soil trenches or onto a prepared dispersal area. Plastic leaching chambers are usually buried underground for practical and aesthetic reasons. They are typically arch-shaped and corrugated, ensuring enough mechanical resistance to minimally sustain backfill load, and in some instances the weight of vehicles that could run over the buried zone. Structural details such as corrugations geometry or pillars (EP2449179) within the chambers may also contribute to a better strength for carrying loads. Typically, chambers have mating ends so that an anterior end of a second chamber will attach to a posterior end of a first chamber, and so on. A string of chambers latched to each other will thus produce a tunnel of a given volume into which water may accumulate and flow.

The void protected volume within the tunnel makes it possible to manage large quantities of water and free up the surfaces required for the treatment or infiltration of water. Water is generally conveyed into the chambers by a pipe inserted within the anterior part of the tunnel (U.S. Pat. Nos. 5,017,041; 5,156,488; 8,337,119; US2007/0231071 A1; CA2535017). Water is thus discharged at the beginning of the tunnel and is then distributed on the receiving surface according to the permeability of the underlying material, its clogging level and the importance of the water volume discharged. This mode of water conveyance leads to an evolution of the treatment systems and the infiltration zones that are said to be "progressive failure", which constitutes the least optimal approach in terms of water and wastewater management. Erosion can also occur at the beginning of tunnels at the discharge area, leading eventually to chambers' seating destabilization and soil collapse. A better water distribution within the tunnels necessarily leads to a better use of the treatment/dispersal surface while minimizing surface erosion, and thus maximizing the system's lifespan. Integrating a pressurized distribution system within the tunnels, using a pumping station and small diameter perforated pipes, have shown to improve water distribution, but this approach does not answer to gravity fed tunnels and requires assembly of many components. Some have developed chambers that integrate a mean for water gravity distribution along a string of chambers, either by providing space and support to install perforated pipes within (Concrete chamber U.S. Pat. No. 4,192,628; Gama Plastic TD-150) or a distribution channel molded directly into a concrete chamber (US36451000). These chambers are either made of concrete, being unstackable and heavy to handle, or require an assembly of pipes and chambers.

There is a need for providing leaching chambers that would overcome at least one drawback of existing systems, such as a light leaching chamber comprising an integrated distribution channel, being stackable, and being able to sustain the load of backfill.

SUMMARY

It has been shown herein that a leaching chamber of the present application provides for an integrated distribution channel. The leaching chamber of the present application further provides for easy shipping, handling and installation, due to its stackability and lightness.

Accordingly, the present application includes a leaching chamber for collecting and dispersing water, comprising:

- an elongated body having a top wall, two opposing sidewalls extending downwardly from each side of the top wall, said elongated body defining an internal chamber for collecting the water and having an open bottom to allow for discharge of the water; and
- a distribution channel formed integrally within the top wall of the elongated body and configured for receiving and dispersing the water, said distribution channel being formed longitudinally and being perforated along the elongated body for draining the water into the internal chamber,
- wherein said elongated body and said distribution channel form a single unitary piece.

In some embodiments, the leaching chamber comprises at least one structural tab having a first end connected to a bottom end of one of the two sidewalls, said at least one structural tab extending perpendicularly through the internal channel and having a second end connected to a bottom end of the other of the two sidewalls, wherein said at least one structural tab is configured to retain the sidewalls and prevent lateral deformation.

Also included is a leaching assembly comprising a plurality of leaching chambers of the present application consecutively connected to form a continuous distribution channel and internal chamber.

The present application further includes a kit for collecting and dispersing water, the kit comprising;

- at least one leaching chamber of the present application;
- at least one structural tab for securing opposing sidewalls of the leaching chamber for preventing lateral deformation of said sidewalls;
- optionally at least one channel cover; and
- instructions of installation.

The present application also includes a kit for collecting and dispersing water, the kit comprising;

- at least one leaching chamber of the present application;
- at least one channel cover; and
- instructions of installation.

Also included is a leaching chamber kit comprising;

- the leaching chamber comprising a single unitary piece defining an open-bottom internal chamber and a distribution channel;

a structural tab for securing opposing sidewalls of the leaching chamber for preventing lateral deformation of said sidewalls;

a channel cover configured for covering the distribution channel and for preventing deformation of the leaching chamber; and instructions of installation.

The present application further provides is a leaching chamber kit comprising;

a plurality of stacked leaching chamber sections, each section comprising a single unitary piece defining an open-bottom internal chamber and an open-top distribution channel;

a plurality of channel covers comprising lateral supports, each channel cover being configured for covering the distribution channel of one of the leaching chamber sections and for preventing deformation of the leaching chamber; and instructions of installation.

Also provided is a kit for preparing a drain field, the kit comprising a stack of a plurality of leaching chambers of the present application;

a plurality of structural tabs for securing opposing sidewalls of the leaching chamber for preventing lateral deformation of said sidewalls;

a plurality of channel covers for covering the distribution channel of one of the leaching chamber; and instructions of installation.

Further included is a method for collecting and dispersing water, the method comprising;

disposing at least one leaching chamber of the present application in a water receiving area and connecting at least one structural tab to said leaching chamber, wherein a first end of said structural tab is connected to a bottom end of one of the two sidewalls, said structural tab extending substantially perpendicularly through the internal chamber and having a second end connected to a bottom end of the other of the two sidewalls;

optionally installing a channel cover;

burying the at least one leaching chamber.

The present application also includes a method for preparing a drain field, the method comprising disposing at least one leaching chamber on a filtration media of the drain field, for collecting and dispersing water and connecting at least one structural tab to said leaching chamber, wherein a first end of said structural tab is connected to a bottom end of one of the two sidewalls, said structural tab extending perpendicularly through the internal chamber and having a second end connected to a bottom end of the other of the two sidewalls;

optionally installing a channel cover;

burying the at least one leaching chamber.

The present application further provides a method of installing a leaching chamber, the method comprising disposing on a surface the leaching chamber comprising a single unitary piece defining an open-bottom internal chamber and an open-top distribution channel;

securing sidewalls of the leaching chamber for preventing lateral deformation of said sidewalls; and covering the distribution channel with a channel cover comprising lateral supports for preventing deformation of the leaching chamber.

Also included is use of a leaching chamber, a leaching assembly or a kit of the present application, for collecting and dispersing water.

Further provided is use of a leaching chamber, a leaching assembly or a kit of the present application, in a drain field for collecting and dispersing water.

Further included is use of a leaching chamber, a leaching assembly or a kit of the present application, for preparing a drain field.

The present application includes a leaching chamber for collecting and dispersing water, comprising:

an elongated body having a top wall, two opposing sidewalls extending downwardly from each side of the top wall, said elongated body defining an internal chamber for collecting the water and having an open bottom to allow for discharge of the water; and comprising at least one structural tab having a first end connected to a bottom end of one of the two sidewalls, said at least one structural tab extending perpendicularly through the internal channel and having a second end connected to a bottom end of the other of the two sidewalls, wherein said at least one structural tab is configured to retain the sidewalls and prevent lateral deformation.

BRIEF DESCRIPTION OF DRAWINGS

The embodiments of the application will now be described in greater detail with reference to the attached drawings in which:

FIG. 1A is a front view; FIG. 1B is a side view; and FIG. 1C is a top view.

FIG. 4D is a front perspective view; FIG. 4B, FIG. 4E and FIG. 4F is an enlarged front perspective view; and FIG. 4C is an enlarged bottom perspective view.

FIG. 6C is a side view; and FIG. 6B and FIG. 6D is a top perspective view.

FIG. 7A is a front view; FIG. 7B is a side view; FIG. 7C is a top perspective view; and FIG. 7D is a bottom perspective view.

FIG. 10A is a front view and FIG. 10B is a top perspective view, according to exemplary embodiments of the application.

FIG. 15A is a side view; FIG. 15B is a front view, FIG. 15C is a perspective top view and FIG. 15D is a side cut view.

DETAILED DESCRIPTION

I. Definitions

Figure 1A:
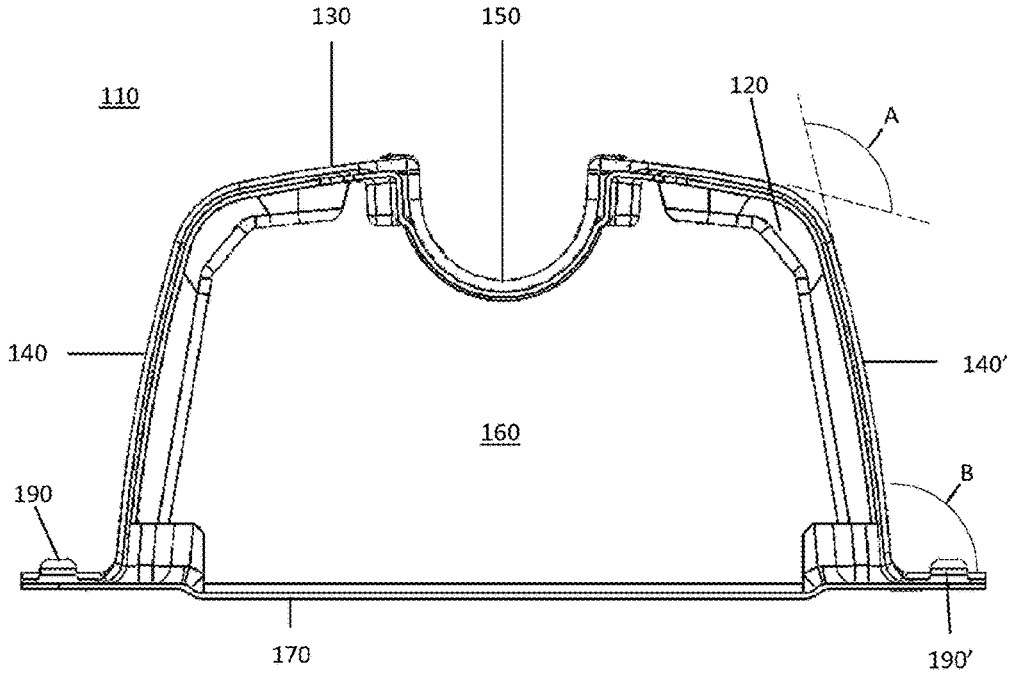
FIG. 1A, FIG. 1B, and FIG. 1C show views of a leaching chamber according to exemplary embodiments of the application.

Unless otherwise indicated, the definitions and embodiments described in this and other sections are intended to be applicable to all embodiments and aspects of the present application herein described for which they are suitable as would be understood by a person skilled in the art.

As used in this application and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements or process steps.

The term "consisting" and its derivatives as used herein are intended to be closed terms that specify the presence of the stated features, elements, components, groups, integers, and/or steps, and also exclude the presence of other unstated features, elements, components, groups, integers and/or steps.

The term "consisting essentially of", as used herein, is intended to specify the presence of the stated features, elements, components, groups, integers, and/or steps as well as those that do not materially affect the basic and novel characteristic(s) of these features, elements, components, groups, integers, and/or steps.

The terms "about", "substantially" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies or unless the context suggests otherwise to a person skilled in the art.

As used in the present application, the singular forms "a", "an" and "the" include plural references unless the content clearly dictates otherwise. For example, an embodiment including "a component" should be understood to present certain aspects with one component, or two or more additional components.

In embodiments comprising an "additional" or "second" component, the second component as used herein is different from the other components or first component. A "third" component is different from the other, first, and second components, and further enumerated or "additional" components are similarly different.

The term "and/or" as used herein means that the listed items are present, or used, individually or in combination. In effect, this term means that "at least one of" or "one or more" of the listed items is used or present.

The term "composition of the application" or "composition of the present application" and the like as used herein refers to a composition comprising one or more material or component of the application.

The term "suitable" as used herein means that the selection of the particular composition or conditions would depend on the specific steps to be performed, the identity of the components to be transformed and/or the specific use for the compositions, but the selection would be well within the skill of a person trained in the art.

II. Materials and Devices of the Application

It has been shown herein that a leaching chamber of the present application provides for an integrated distribution channel. The mechanical resistance of a leaching chamber that allows for heavy loads application without breakage may be ensured by one or more structural tab. A leaching chamber of the present application further provides for easy shipping, handling and installation, because of its stackability and lightness. Comparable leaching chamber did not display the same properties, highlighting the results obtained with the leaching chamber of the application.

Accordingly, the present application includes a leaching chamber for receiving, collecting and dispersing water, comprising: an elongated body having a top wall, two opposing sidewalls extending downwardly from each side of the top wall, said elongated body defining an internal chamber for collecting the water and having an open bottom to allow for discharge of the water; a distribution channel formed integrally within the top wall of the elongated body and configured for receiving and dispersing the water, said distribution channel being formed longitudinally and being perforated along the elongated body for draining the water into the internal chamber, and wherein said elongated body and said distribution channel form a single unitary piece. In some embodiments, the elongated body has a height to width ratio (i.e. the height of a sidewall compared to the width of the top wall) of about 1:1 to about 1:3. In some embodiments, the elongated body has a height to width ratio of about 1:1.5 to about 1:2.5. In some embodiments, the elongated body has a height to width ratio of about 1:2. In some embodiments, the top wall has a width of about 5 inches to about 50 inches (about 12.5 cm to about 127 cm), or about 10 inches to about 40 inches (about 25 cm to about 102 cm), or about 12 inches to about 36 inches (about 30 cm to about 91 cm). In some embodiments, the sidewalls have a height of 2 inches to about 25 inches (about 5 cm to about 64 cm), or about 5 inches to about 20 inches (about 12.5 cm to about 51 cm), or about 6 inches to about 18 inches (about 15 cm to about 46 cm). In some embodiments, each end of the two opposing sidewalls is provided with sitting ends extending outwardly from the internal chamber. In some embodiments, the sitting ends are configured for resting on a surface to provide stability and distribute the weight of the leaching chamber to minimize sinking of the leaching chamber within a sitting surface. In some embodiments, the sitting ends have a width of about 0.1 inch to about 2 inches (about 0.25 cm to about 5 cm). In some embodiments, the sitting ends have a width of about 0.2 inch to about 1.8 inches (about 0.5 cm to about 4.6 cm), or about 0.5 inch to about 1.5 inches (about 1.3 cm to about 3.8 cm).

Figure 13:
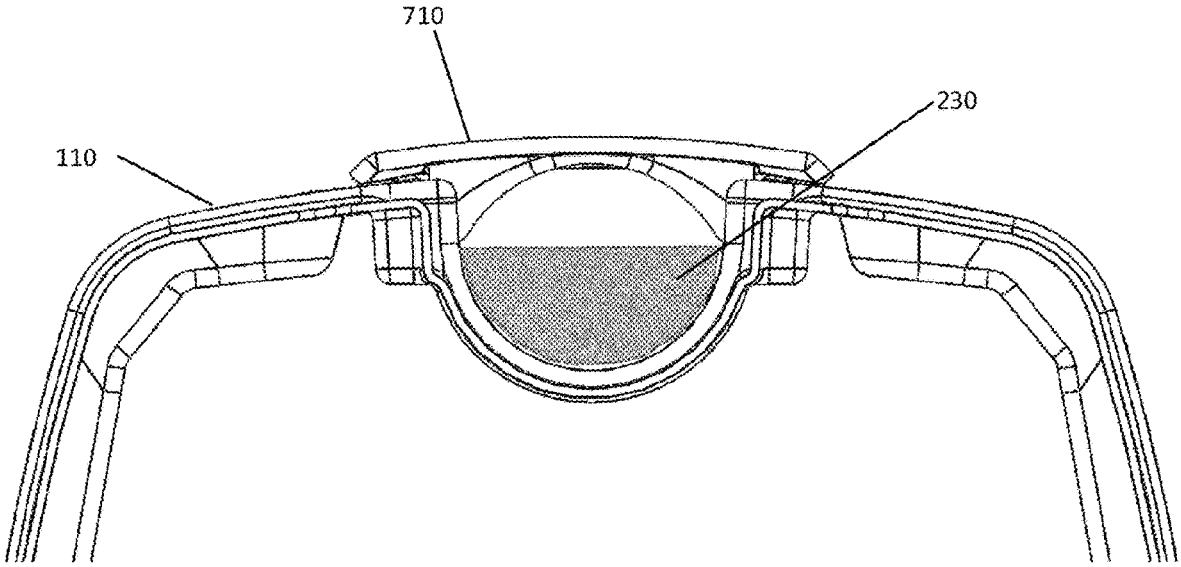
FIG. 13 shows a front view illustrating the flowing section of the distribution channel, according to exemplary embodiments of the application.

A perforated distribution channel is formed along the top wall of the elongated body, the elongated body and the distribution channel forming a single unitary piece. In some embodiments, perforations are positioned at regular intervals at the bottom or lateral sides of the channel, or a combination of both. Perforations may be slots, holes or a combination of both. In some embodiments, some perforations may be substantially centered at the bottom of the distribution channel. In some embodiments, lateral perforations may extend at an angle from about 0 degrees to about 80 degrees from the bottom center along the lateral sides of the channel, or from about 10 degrees to about 70 degrees, or from about 0 degrees to about 50 degrees. In some embodiments, perforations are present in a ratio of about 1 perforation per meter to about 24 perforations per meter. In some embodiments, perforations are present in a ratio of about 5 perforations per meter to about 20 perforations per meter. In some embodiments, perforations are present in a ratio of about 14 perforations per meter to about 18 perforations per meter. In some embodiments, perforations are present in a ratio of about 3 perforations per meter to about 12 perforations per meter. In some embodiments, a depression localized at the inlet side (anterior) of the distribution channel allows the reception of the bottom of a previous leaching chamber upon assembly (see FIG. 5). In some embodiments, the depth of this depression is relative to the thickness of the material used so that there is a continuity of the distribution channel along a plurality of leaching chambers string. In some embodiments, the distribution channel is configured to form a circular conduit having a diameter of about 2 inches to about 6 inches (about 5 cm to about 15 cm). In some embodiments, the distribution channel is configured to form a conduit having a width of about 2.5 inches to about 5.5 inches (about 6 cm to about 14 cm), or about 3 inches to about 5 inches (about 8 cm to about 13 cm). As will be appreciated and illustrated in FIG. 13 for a circular shape, the distribution channel will define a flowing section 230 where water will be received and dispersed, and drained into the internal chamber through the perforations. In some embodiments, the distribution channel is configured to form a non-circular shape or irregular shape, and the surface area of the distribution channel corresponding to the flowing section 230 as shown in FIG. 13, is about 1.5 inches$^2$ to about 15 inches$^2$ (about 10 cm$^2$ to about 97 cm$^2$), or about 2.5 inches$^2$ to about 12.5 inches$^2$ (about 16 cm$^2$ to about 81 cm$^2$), or 5 inches$^2$ to about 10 inches$^2$ (about 32 cm$^2$ to about 65 cm$^2$). In some embodiments, the distribution channel is a closed conduit forming part of the single unitary piece. In some embodiments, the distribution channel has an open top configured to be covered for protecting said distribution channel from backfill when buried. In some embodiments, the distribution channel is configured to form a conduit having a cross-section having a circular shape, an oval shape, a triangular shape, a rectangular shape, a pentagonal shape, a hexagonal shape, a heptagonal shape, an octagonal shape, or a dodecagonal shape, or any other suitable polygonal shape. Without being bound to theory, it will be appreciated that the distribution channel being integrally formed as a closed conduit may present the advantage of simplified manufacture or leaching assembly as part of the single unitary piece leaching chamber, but would compromise on the advantage of multiple leaching chambers being easily stackable. One may want to favor one advantage over the other according to special requirements, conditions, limitations, and this would be well within the purview of a skilled person in the art.

Without being bound to theory, the addition of a distribution channel along the leaching chamber's top wall reduces its mechanical resistance against vertical and lateral constraints. Thus, additional structures may be included within the chamber's design to compensate for this increased weakness. In some embodiments, the additional structures improving resistance may be selected from one or many structural tabs, fastening means between consecutive leaching chambers, at least one channel cover including lateral supports, and combinations thereof.

In some embodiments, at least one structural tab is added to the leaching chamber, being integrally formed with the leaching chamber or being an individual, separate component connecting both sidewalls, to counteract lateral deformations (inward and outward) that could occur under constraints. In some embodiments, the constraints are the weight of the backfill upon burial of the leaching chamber, the weight of individuals or vehicles circulating on top of the backfill zone such as cars, trucks, lawnmowers, etc., the weight of snow on top of the backfill zone, and combinations thereof.

In some embodiments, the leaching chamber comprises at least one structural tab having a first end connected to a bottom end of one of the two sidewalls, said at least one structural tab extending perpendicularly through the internal channel and having a second end connected to a bottom end of the other of the two sidewalls, wherein said at least one structural tab is configured to retain the sidewalls and prevent lateral deformation. Without being bound to theory, structural tabs of the present application may act in a similar manner as rafter ties or tie-beams in the field of building construction. A rafter tie serves are utilized at the bottom of the joist and can double as a ceiling joist, they help keep walls from spreading apart and act as a tension member to resist gravity pushing out from the weight of the roof.

In some embodiments, the at least one structural tab has a width of about 1 inch to about 6 inches (about 2.5 cm to about 15 cm). In some embodiments, the structural tab has a width of about 1 inch to about 4.5 inches (about 2.5 cm to about 11 cm), or about 1 inch to about 3 inches (about 2.5 cm to about 8 cm). In some embodiments, the at least one structural tab is integrally formed within the single unitary piece as shown on FIG. 1A-FIG. 1C, from one sidewall to the other. In some embodiments, the at least one structural tab is a separate component as shown on FIG. 3. In some embodiments, the structural tab as a separate component is removably fixable to the bottom end of each of the opposing sidewalls. It will be appreciated that the structural tab may be installed at any position along the length of the leaching chamber to connect the sitting ends of each of the opposing sidewalls. In some embodiments, the at least one structural tab is provided at one end of the leaching chamber and may receive two ends of adjacent leaching chambers upon assembly. In some embodiments, the at least one structural tab as a separate component is configured to fit the distance between the opposing sidewalls and receive the sitting end of each opposing walls. In some embodiments, a leaching chamber is configured with one structural tab at each end of the chamber, each of the structural tab configured for receiving and connecting a leaching chamber which does not comprise any structural tab.

Figure 1B:
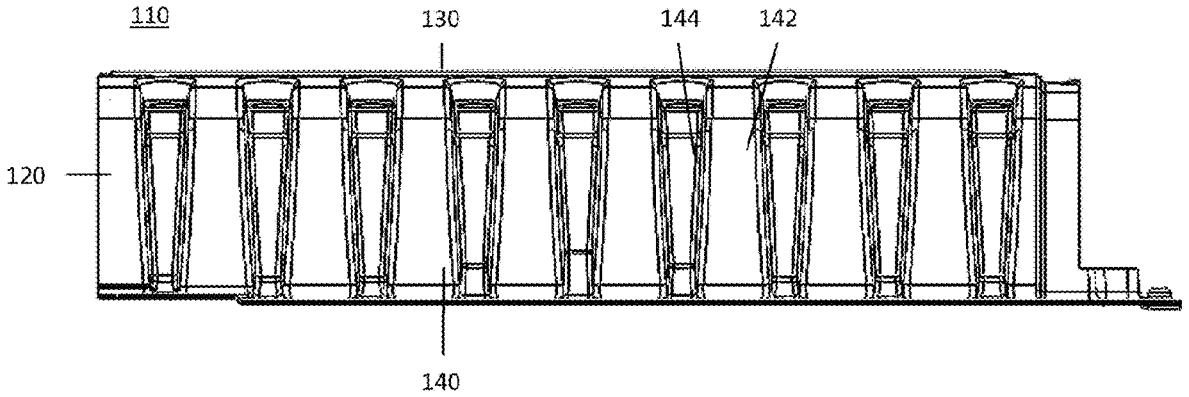
Figure 1C:
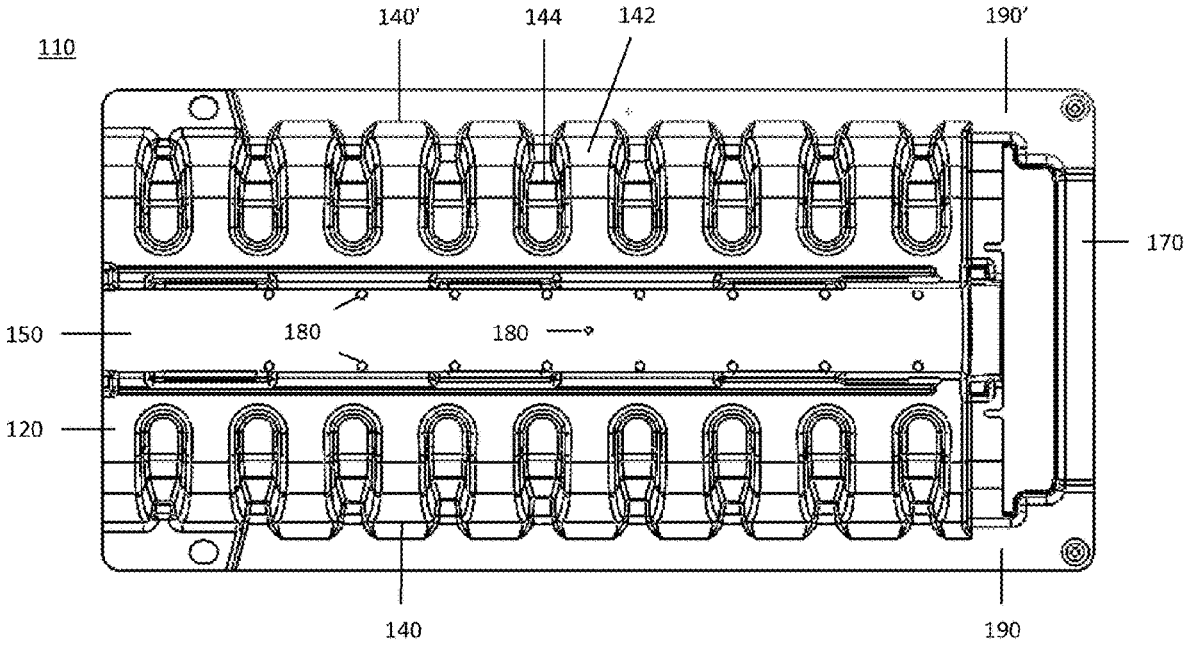

FIGS. 1A, 1B and 1C show an exemplary leaching chamber 110. Elongated body 120 having a top wall 130, opposing sidewalls 140, 140', and distribution channel 150, are shown defining an internal chamber 160. One structural tab 170 is shown in this embodiment as part of a single unitary piece together with elongated body 120 and distribution channel 150. Perforations 180 are shown at regular intervals along the sides of the distribution channel 150. In this exemplary leaching chamber, the sidewalls 140, 140' are corrugated on their length with alternating peaks 142 and valleys 144. Sitting ends 190, 190' are also shown at each end of opposing sidewalls 140, 140'.

In some embodiments, the angle A formed between the top wall 130 and the sidewalls 140, 140' of the leaching chamber 110 is from about 90° to about 135°. In some embodiments, the angle A is from about 90° to about 125°. In some embodiments, the angle A is from about 90° to about 115°. In some embodiments, the angle A is from about 90° to about 105°. In some embodiments, the angle B formed between the sidewalls 140, 140' and the sitting ends 190, 190' is from about 90° to about 135°. In some embodiments, the angle B is from about 90° to about 125°. In some embodiments, the angle B is from about 90° to about 115°.

Figure 2:
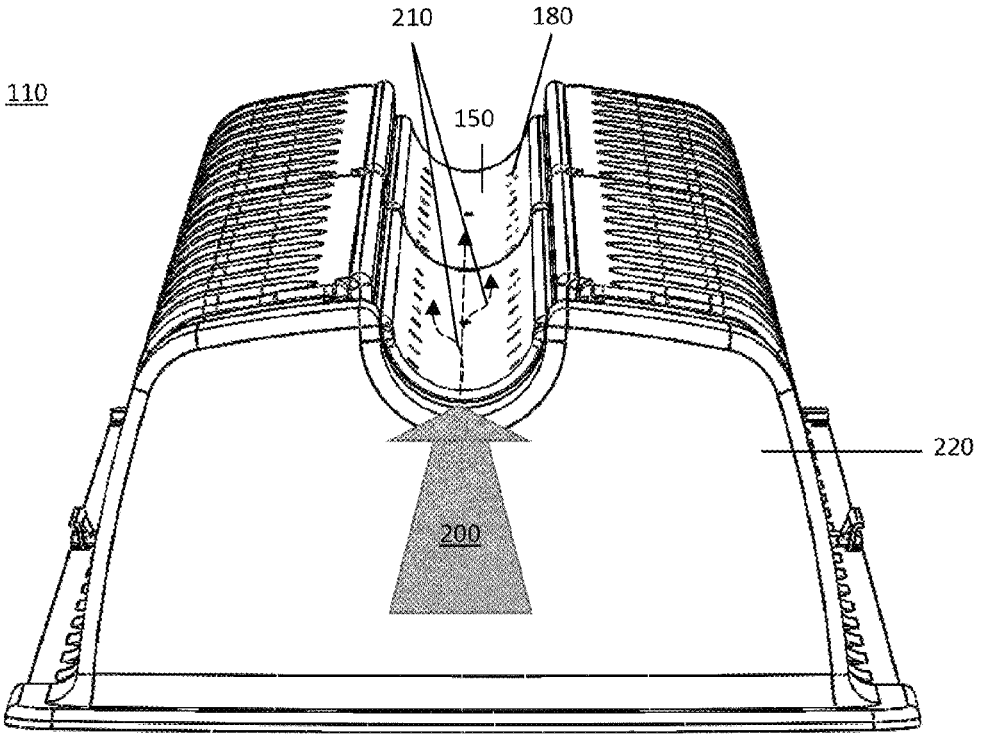
FIG. 2 shows a front perspective view illustrating water flow within a distribution channel of a leaching chamber according to exemplary embodiments of the application.

FIG. 2 illustrates the flow of water within the distribution channel 150 of a leaching chamber 110, where the large arrow 200 represents the inlet flow. While flowing along the distribution channel 150, the water will drain to the interior of the chamber through the perforations 180 along the channel 150, as shown by the small arrows 210. In the particular exemplary embodiment shown on FIG. 2, an end cap 220 is provided at the end of the chamber to close the internal chamber. A skilled person in the art will understand that such an end cap would need to be complementary to the end of the chamber and will fully appreciate when and where an end cap would be required.

Figure 3:
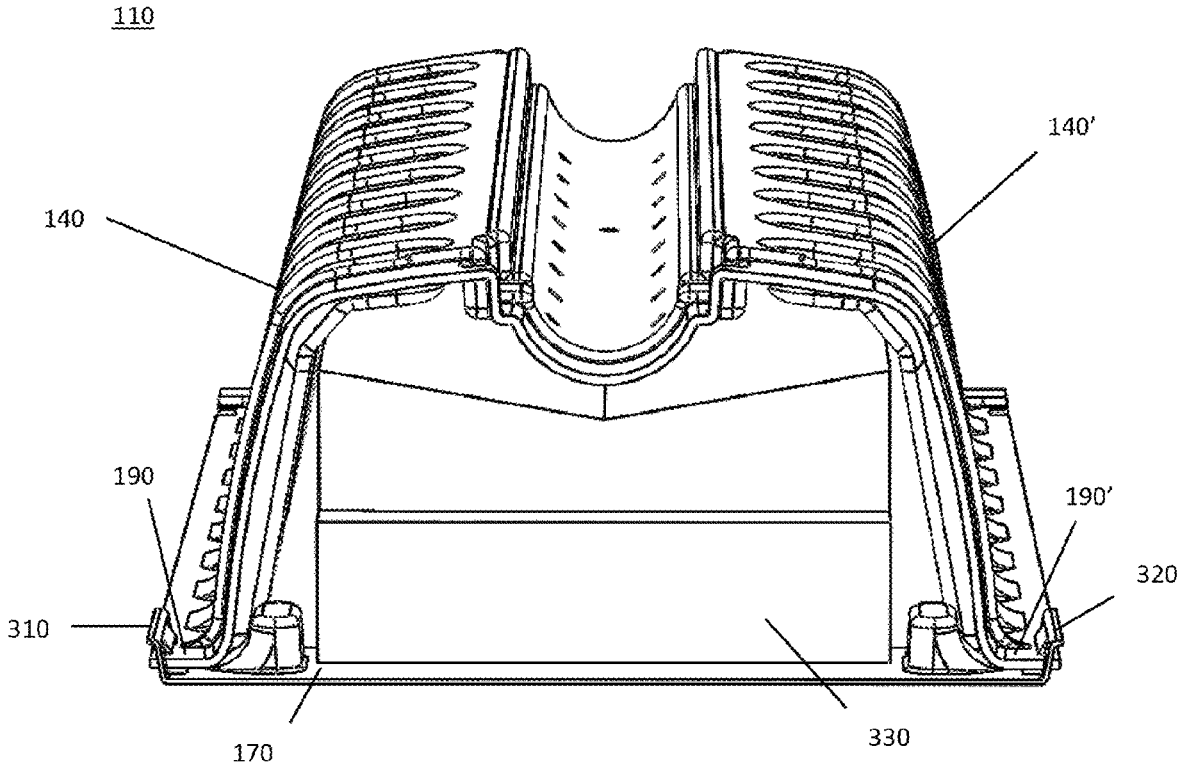
FIG. 3 shows a front perspective view of a leaching chamber according to exemplary embodiments of the application.

FIG. 3 illustrates an embodiment wherein the structural tab 170 is a separate component from the leaching chamber 110. The structural tab 170 is shown with a first end 310 connected to a sitting end 190 of one of the two sidewalls 140, extending perpendicularly through the internal chamber 160 and having a second end 320 connected to a sitting end 190' of the other of the two sidewalls 140'. In this exemplary embodiment, the leaching chamber 110 is shown comprising a filtration bloc 330.

Figure 4A:
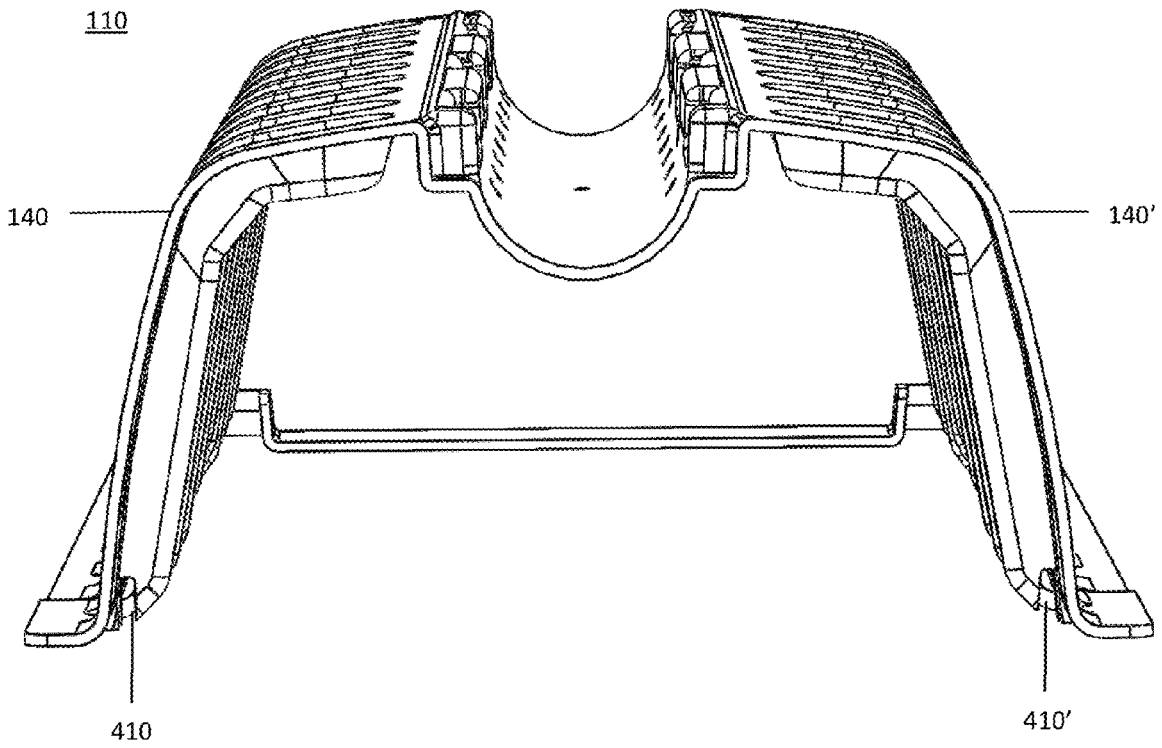
FIG. 4A, FIG. 4B, FIG. 4C, FIG. 4D, FIG. 4E and FIG. 4F show views of exemplary fastening means of a leaching chamber according to exemplary embodiments of the application, FIG. 4A
Figure 4B:
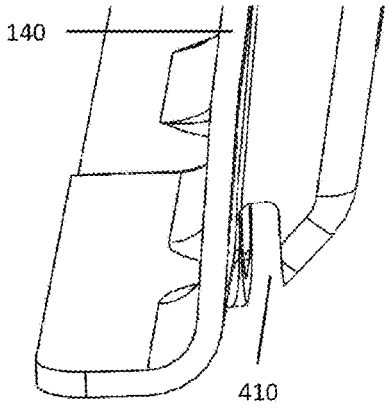
Figure 4C:
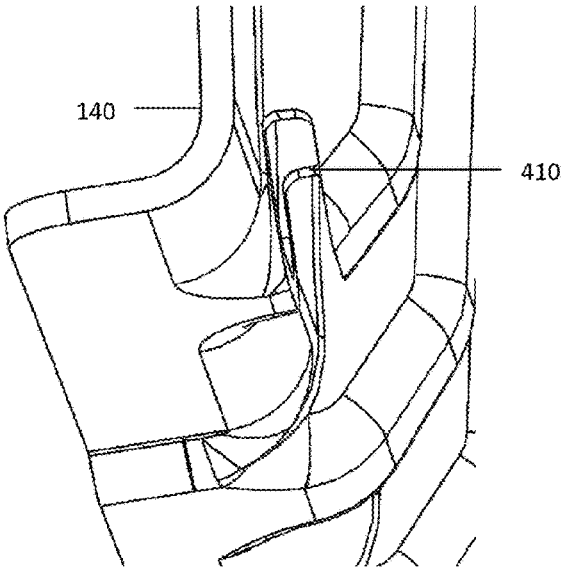
Figure 4D:
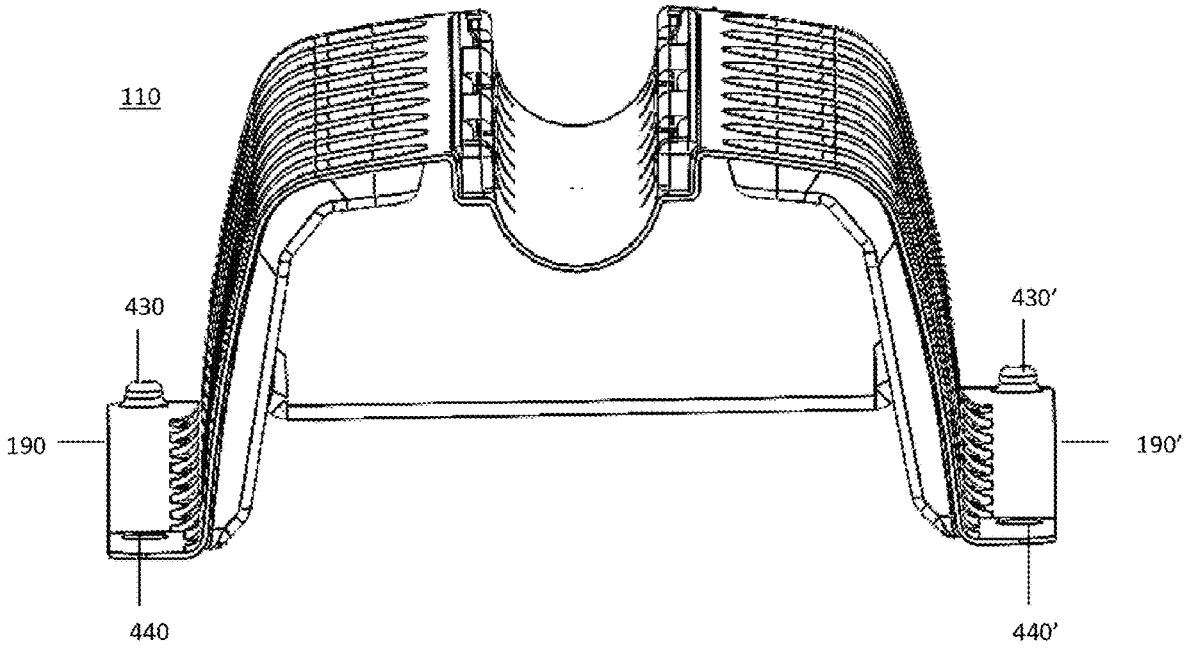
Figure 4E:
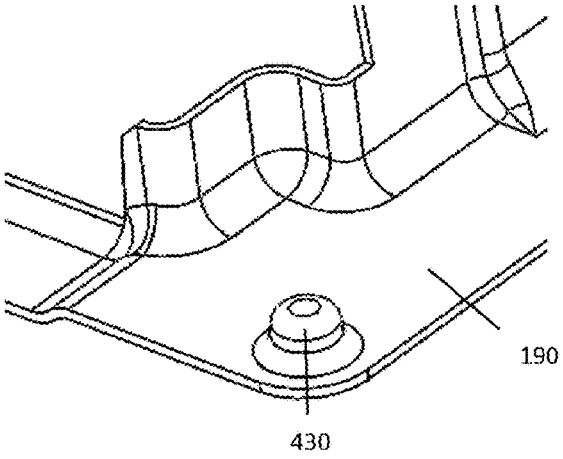
Figure 4F:
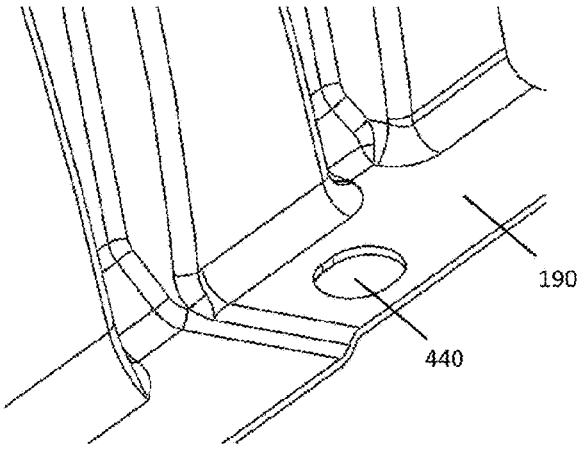

In some embodiments, fastening means are provided at each end of the leaching chamber. In some embodiments, upon assembly of a plurality of leaching chambers, overlapping consecutive chambers' ends (posterior end of one chamber on anterior end of another chamber) allows for a complementary support benefiting to the whole chamber assembly. In some embodiments, the leaching chamber comprises fastening means at each end of the elongated body for securing multiple leaching chambers consecutively. In some embodiments, fastening means on one end of a leaching chamber is complementary to fastening means on one end of a second leaching chamber. In some embodiments, fastening means comprise slots 410, 410' located on the inner sidewalls 140, 140' of the posterior end of one leaching chamber 110 as shown on FIGS. 4A, 4B and 4C, and complementary notches 420, 420' located on the low walls 140, 140' of the anterior end of a leaching chamber 110 as shown on FIG. 5A, such that connection of the slots 410, 410' and notches 420, 420' together on each end of two adjacent leaching chambers will securely retain both chambers together, thus preventing the chambers to move from one another and contributing to the integrity of the assembly of the plurality of leaching chambers. In some embodiments, fastening means comprise protrusions 430, 430' located on the sitting ends 190, 190' of the posterior end of one leaching chamber 110 as shown on FIGS. 4D and 4E (see also FIG. 5B), and complementary holes 440, 440' located on the sitting ends 190, 190' of the anterior end of a leaching chamber 110 as shown on FIG. 4F, such that connection of the protrusions 430, 430' within holes 440, 440' on each end of two adjacent leaching chambers will securely retain both chambers together. In some embodiments, holes may be instead slightly larger protrusions, mating with, over protrusions 430, 430'. A skilled person will appreciate that a combination of fastening means may be contemplated, for example a different means on each sidewalls or different forms and shapes, provided that the configuration of one end of a leaching chamber is complementary to one end of another leaching chamber. In some embodiments, the structural tab from one chamber's anterior end then complements the absence of a tab at the posterior end to convey mechanical resistance to this end.

Figure 5A:
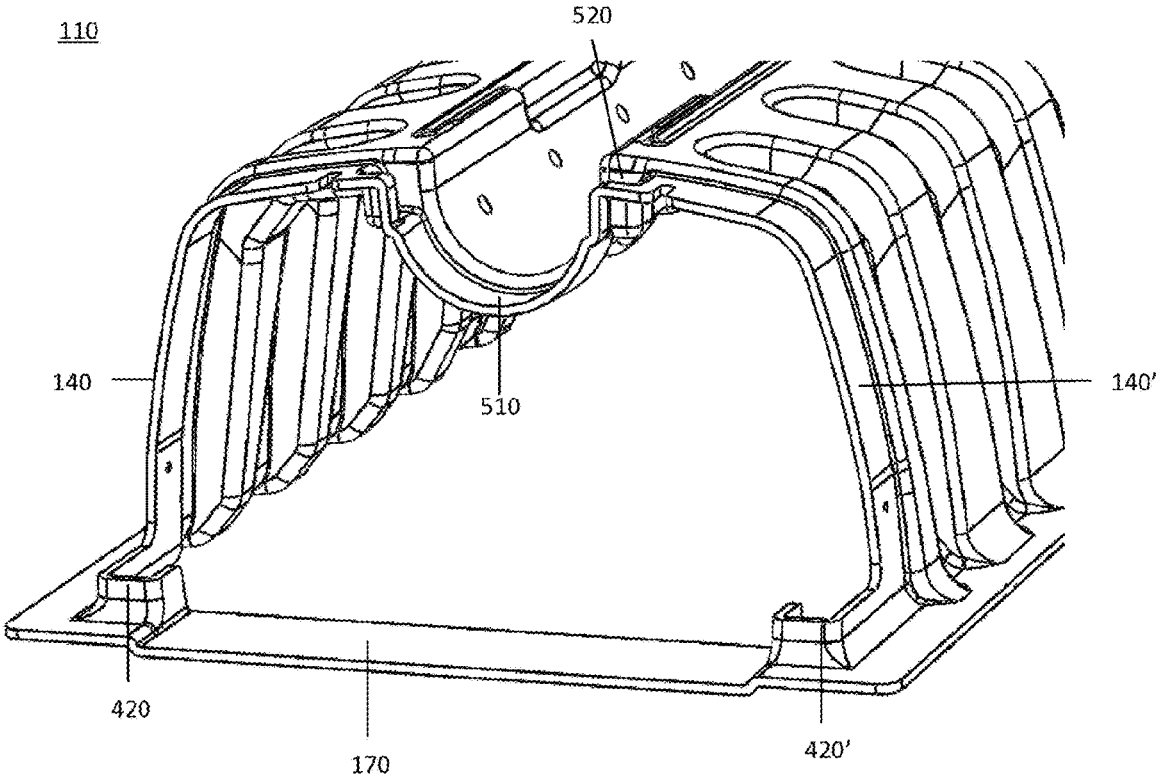
FIG. 5A and FIG. 5B shows a front perspective view of an end of a leaching chamber according to exemplary embodiments of the application.
Figure 5B:
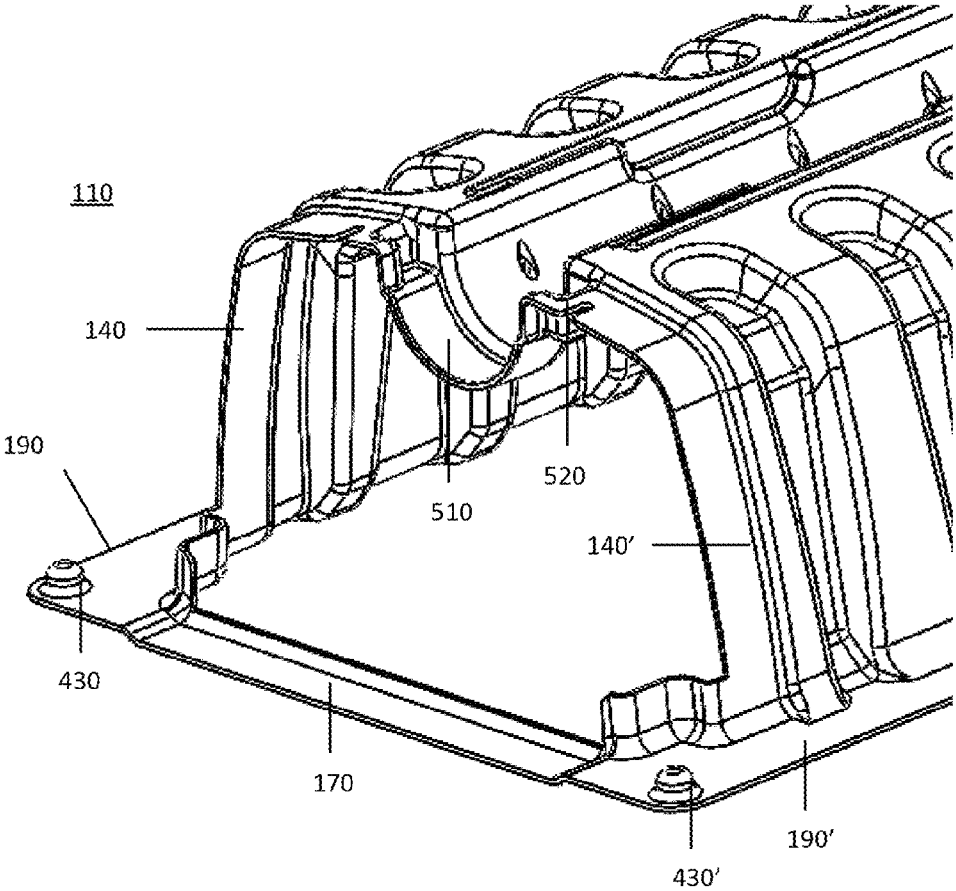

Without being bound to theory, depressions on the anterior end's walls, shoulders and distribution channel, depth relative to the material thickness, allows for a continuity of the chamber string structures. Low steps located on both posterior end chamber's sitting ends, height relative the material thickness, allows chamber assembly's structure continuity and level. FIGS. 5A and 5B show a depression 510 at the end of the distribution channel, depression 520 at the edge of the top wall 130 and sidewalls 140, 140'. FIGS. 5A and 5B also show an integrated structural tab 170 with fastening means being notches 420, 420' in FIG. 5A or protrusions 430, 430' in FIG. 5B. It will be appreciated that any suitable means may be used, allowing continuity of the chambers connected together, such as overlap, insertion, use of an additional connector, etc. and the application is not limited thereto.

Figure 6A:
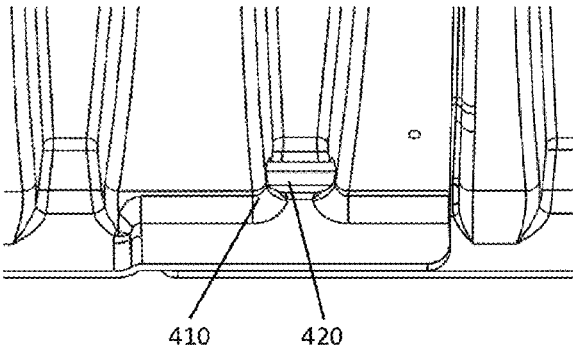
FIG. 6A, FIG. 6B, FIG. 6C and FIG. 6D show views of two leaching chambers fastened together, according to exemplary embodiments of the application, FIG. 6A
Figure 6B:
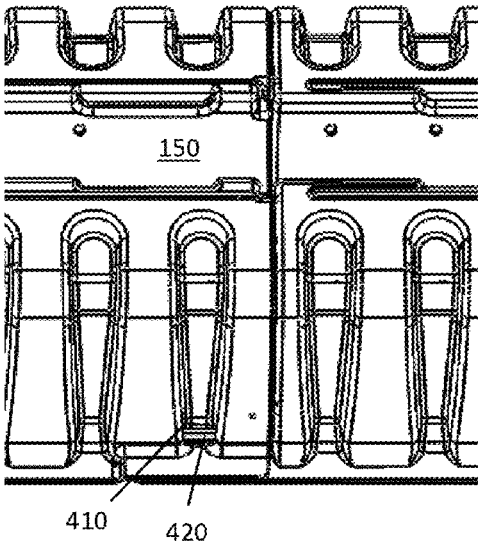
Figure 6C:
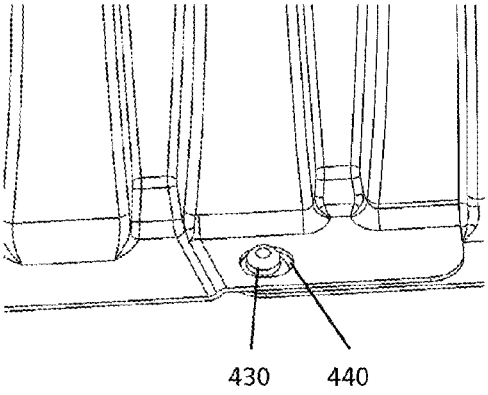
Figure 6D:
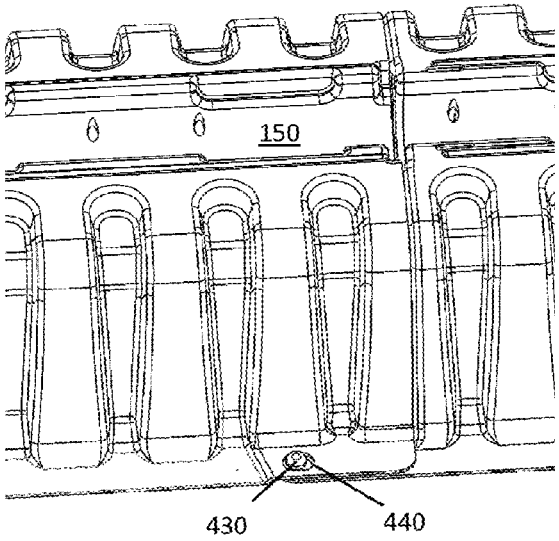
Figure 7A:
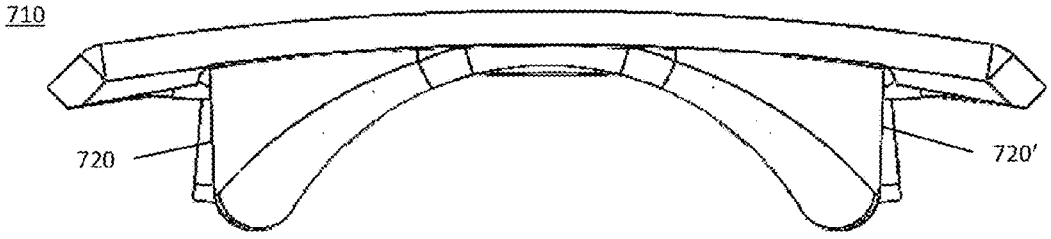
FIG. 7A, FIG. 7B, FIG. 7C and FIG. 7D show views of cover for a leaching chamber according to exemplary embodiments of the application.
Figure 7B:
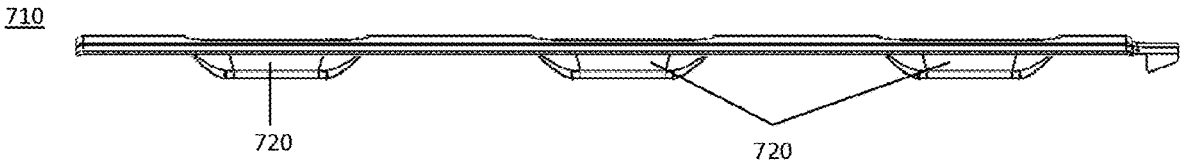
Figure 7C:
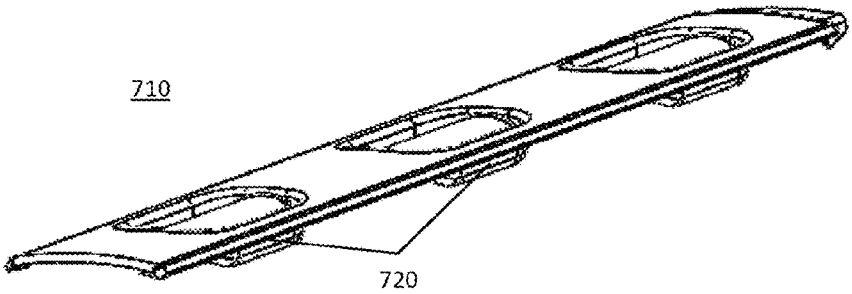
Figure 7D:
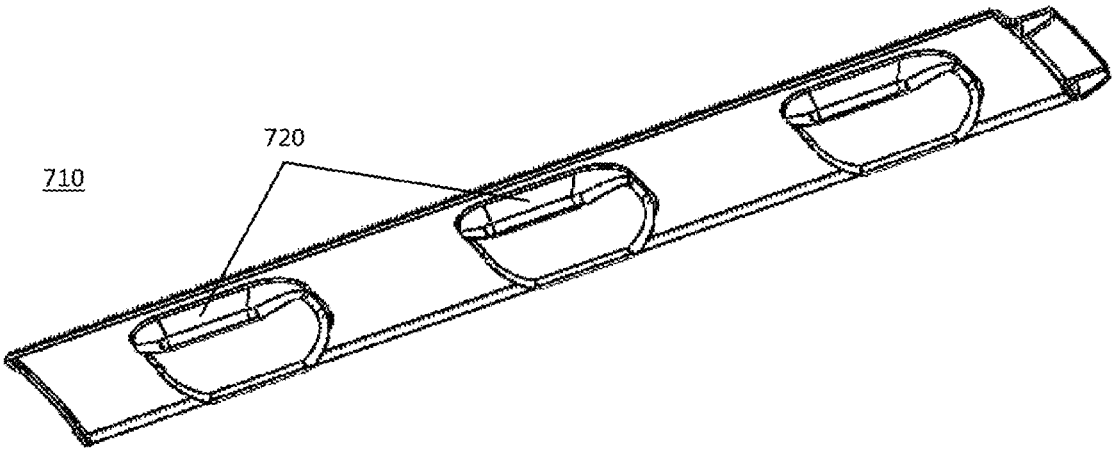

FIGS. 6A, 6B, 6C and 6D show exemplary embodiments of two leaching chambers connected together, with different fastening means embodiments. FIG. 6A emphasizes on an exemplary fastening means as complementary slot 410 and notch 420 configuration. FIG. 6C emphasizes on an exemplary fastening means as complementary protrusion 430 and hole 440 configuration. FIGS. 6B and 6D show continuous distribution channel 150 of two leaching chambers connected together provided by the overlap of one end of the distribution channel 150 of one chamber sitting on a depression in the distribution channel of the other chamber.

Figure 14A:
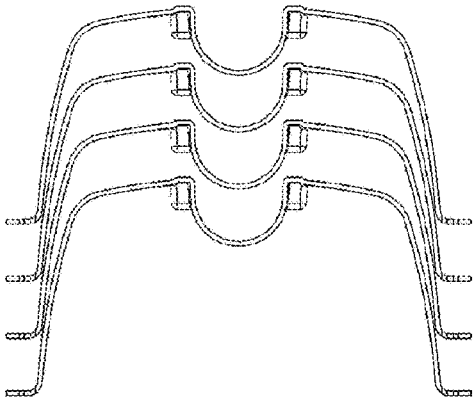
FIG. 14A and FIG. 14B show a front view illustrating stacked leaching chambers, according to exemplary embodiments of the application.
Figure 14B:
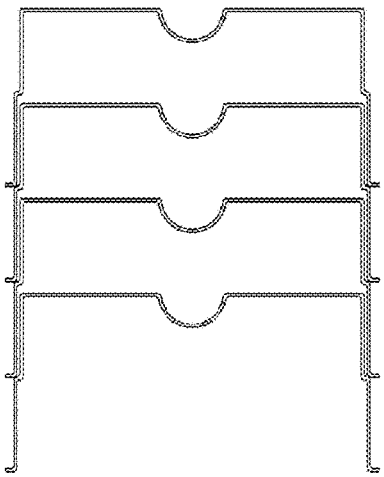
Figure 15A:
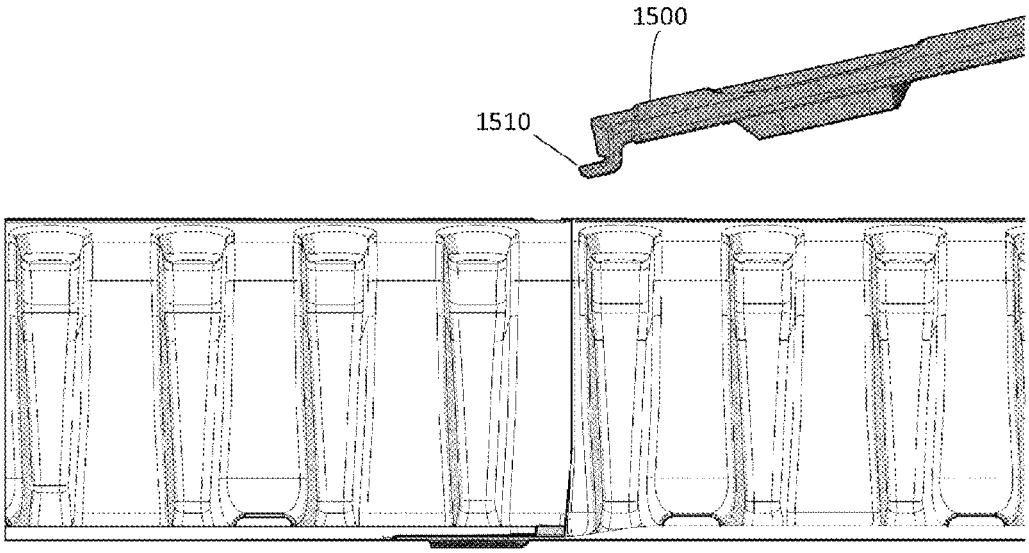
FIG. 15A, FIG. 15B, FIG. 15C and FIG. 15D show views of an alternate cover and assembly for a leaching chamber according to exemplary embodiments of the application; where
Figure 15B:
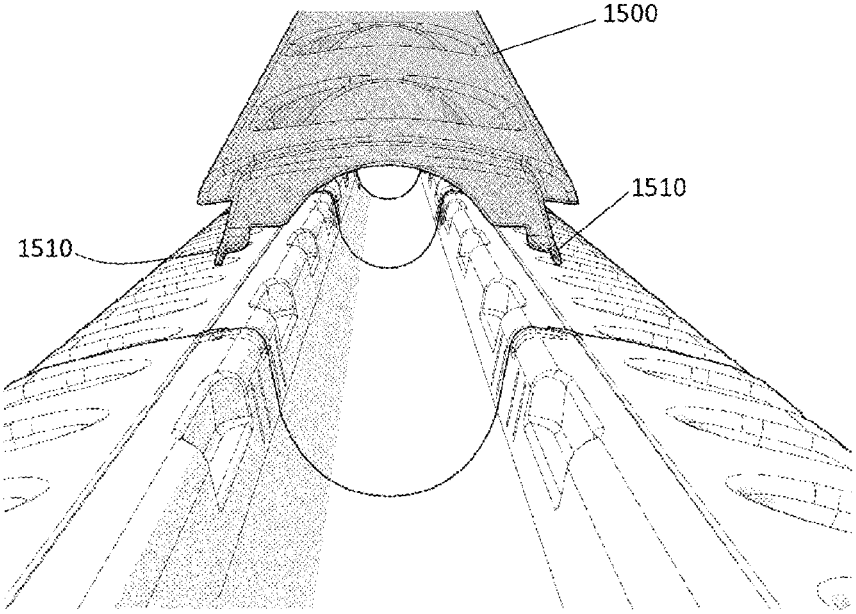
Figure 15C:
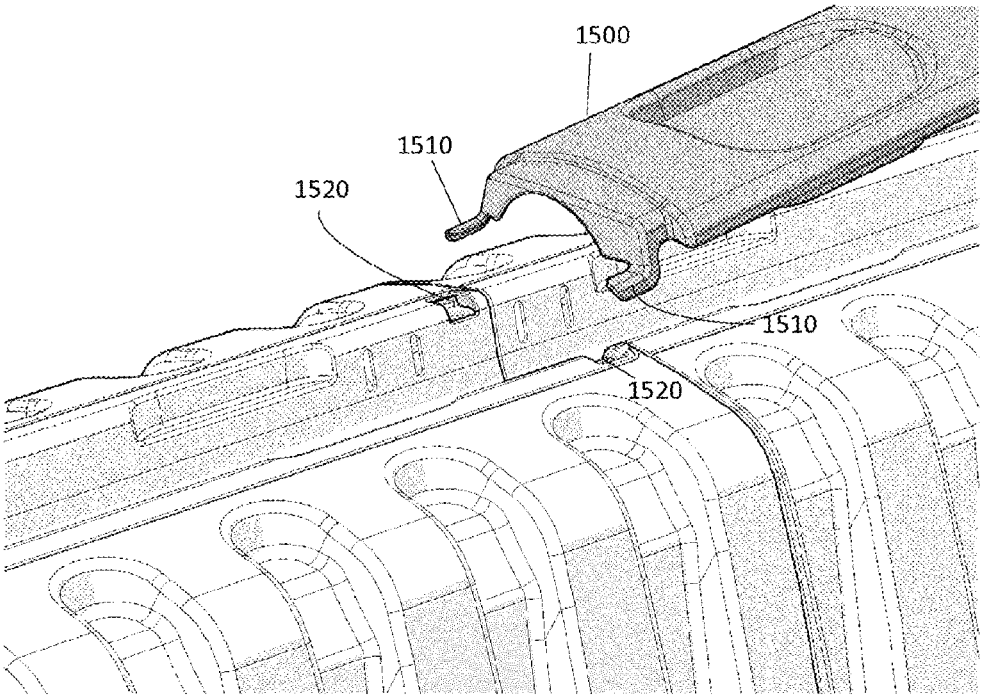
Figure 15D:
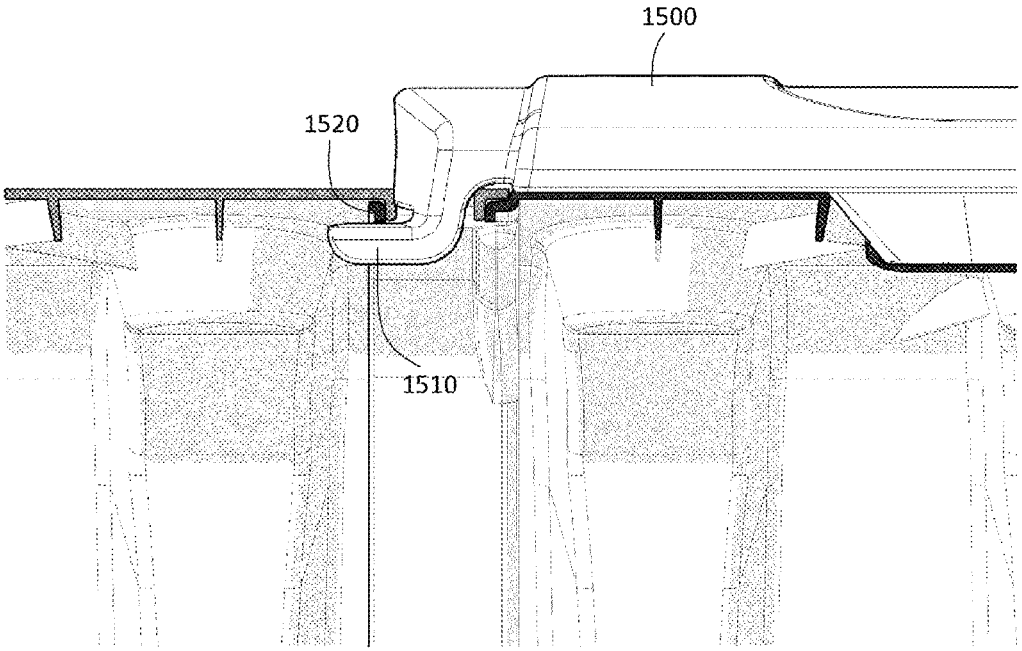

Without wishing to be bound to theory, it will be appreciated that the different configurations, such as the angles between the different parts, the specific shapes of each part of the leaching chambers, etc., may be slightly adjusted to allow a design providing a better stackability of the leaching chambers one on top of another, for ease of storage, transportation, etc. Stackability may also be affected by flexibility of the material. In some embodiments, a substantially snug fit may be provided between adjacent stacked leaching chambers. In some embodiments, a space of variable dimension may be present between two consecutive stacked leaching chambers. For example, embodiments are illustrated in FIG. 14A and FIG. 14B showing stacks of leaching chambers, where FIG. 14A shows a favorable stacking design and FIG. 14B shows an alternate design where a recess is incorporated in the sidewalls to allow for stackability. Choice of specific designs and configurations would be well within the purview of a skilled person in the art.

Figure 8A:
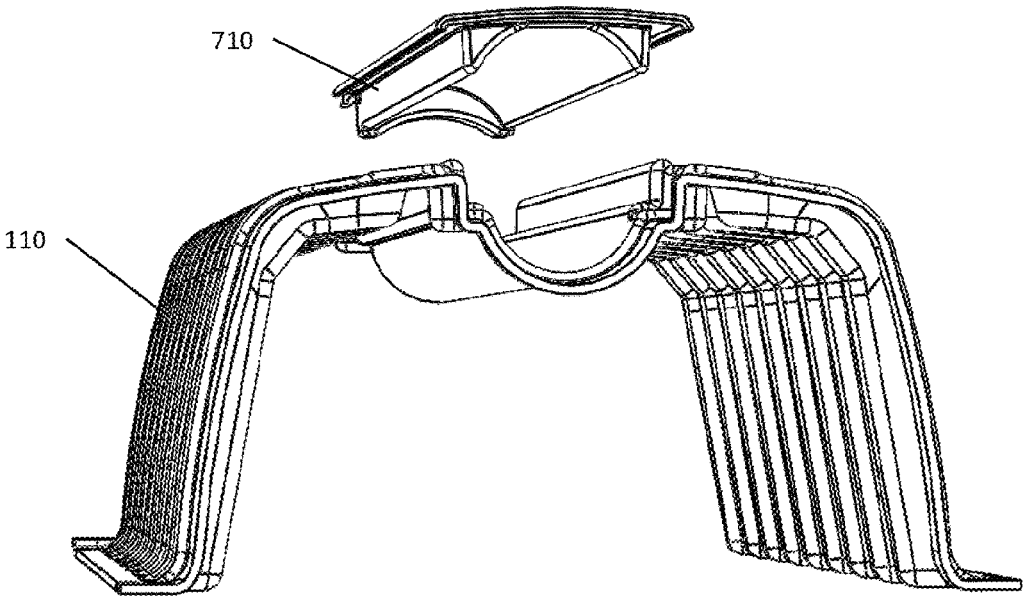
FIG. 8A and FIG. 8B show perspective views of a leaching chamber and cover, according to exemplary embodiments of the application.
Figure 8B:
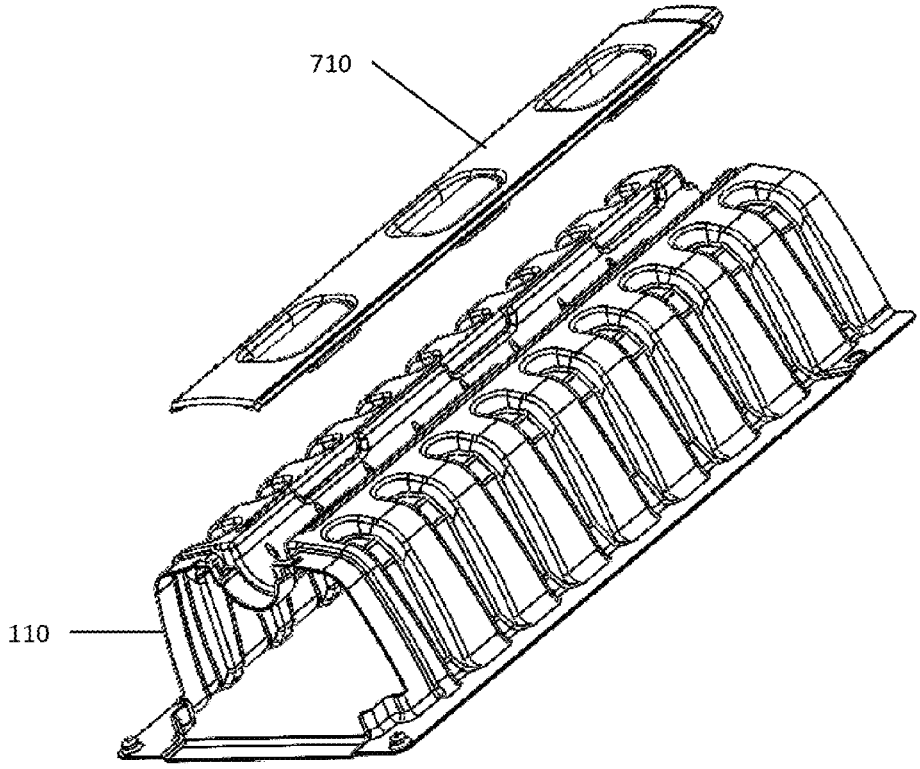

In some embodiments, as previously mentioned, the distribution channel has an open top and needs to be covered with a channel cover to be installed on top of the channel, as shown on FIGS. 8A and 8B, to protect the distribution channel from backfill upon burial of the leaching chamber.

Without being bound to theory, the cover increases the chamber's strength against constraints, acting as a keystone. Arched lateral support(s), part of the cover design and located on the bottom face of the cover, may sit on depression(s) molded on each side of the distribution channel. An exemplary channel cover 710 is shown on FIGS. 7A, 7B, 7C and 7D, with lateral supports 720, 720'. Without being bound to theory, lateral constraints coming for the chamber deformation may be counteracted by the contact between the depressions' wall and the lateral supports. This contact combined with the arch's geometry counteract chamber deformation when put under constraints and will thus act as a keystone.

In some embodiments, the lateral supports will be present on about 25% to about 100% of the length of the cover. In some embodiments, the lateral supports will be present on about 30% to about 90% of the length of the cover, or about 40% to about 75%. In some embodiments, the lateral supports extend on about 100% of the cover, as shown on the exemplary embodiment shown on FIG. 8A. In some embodiments where the lateral supports are not present on 100% of the length, the lateral supports may comprise more than one section, such as the exemplary embodiment shown on FIGS. 7A, 7B, 7C and 7D, and FIG. 8B. In some embodiments, the height of the lateral supports is about 5% to about 50% of the height of the distribution channel. In some embodiments, the height of the lateral supports is about 15% to about 45% of the height of the distribution channel. In some embodiments, the height of the lateral supports is about 25% to about 40% of the height of the distribution channel.

Figure 9:
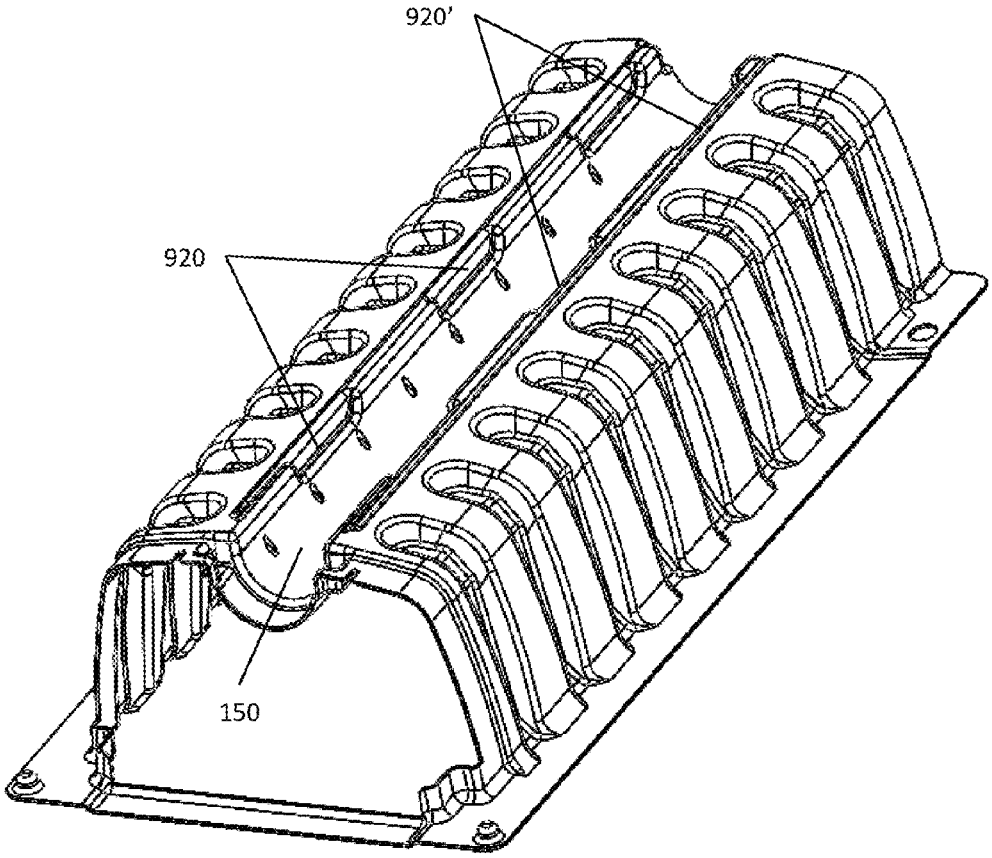
FIG. 9 shows a front perspective view of a leaching chamber including exemplary top depressions for receiving a cover, according to exemplary embodiments of the application.
Figure 10A:
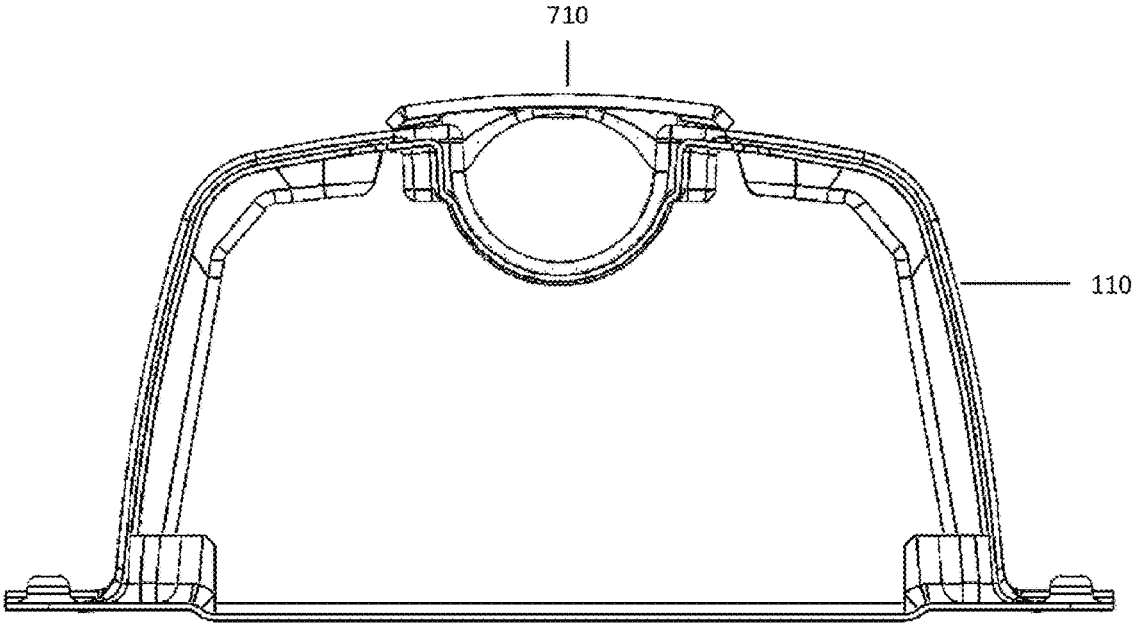
FIG. 10A and FIG. 10B show an assembled leaching chamber and cover.
Figure 10B:
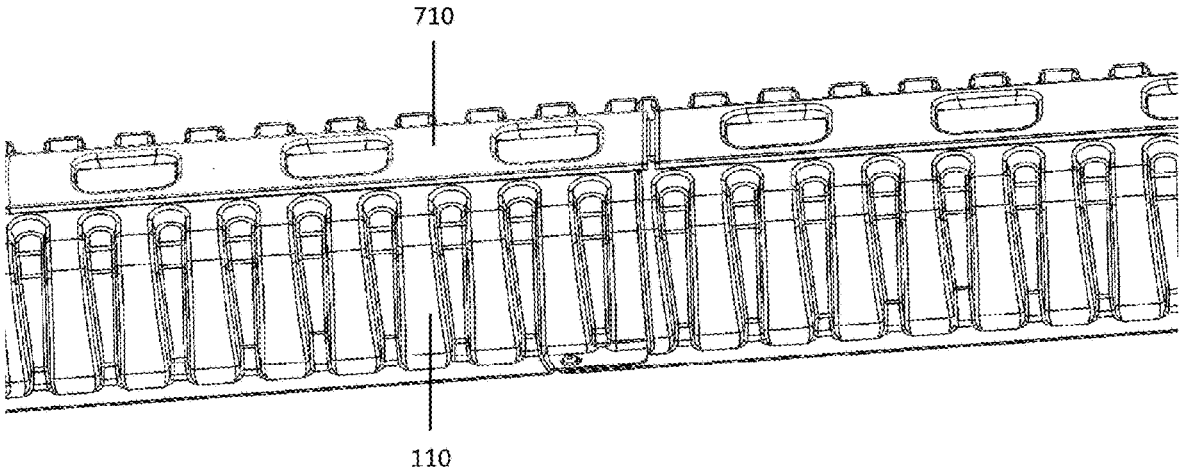
Figure 11:
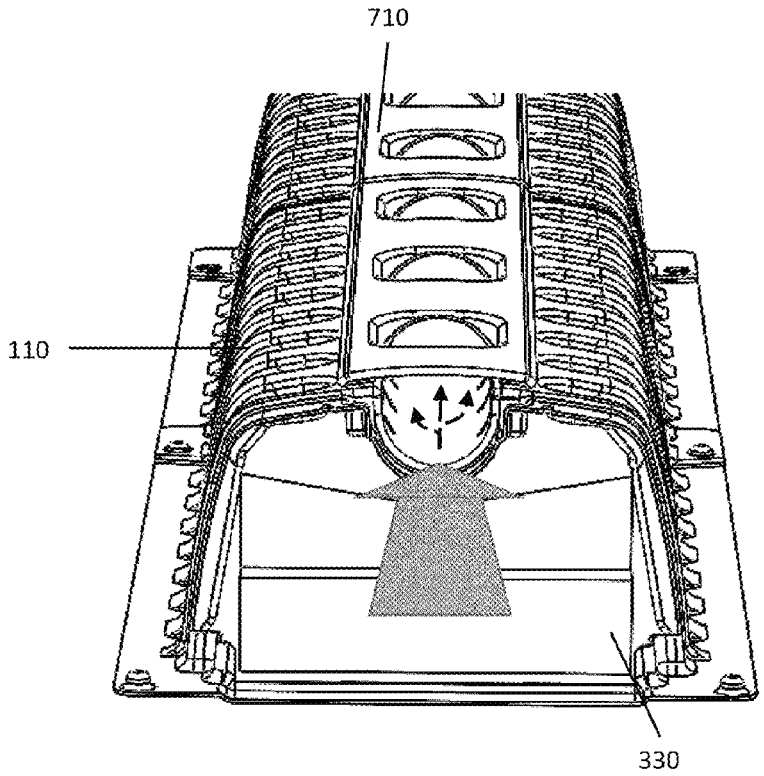
FIG. 11 shows a front perspective view of an assembled leaching chamber and cover illustrating water flow, according to exemplary embodiments of the application.

As an exemplary embodiment, depressions 920, 920' are shown on each side of the distribution channel 150 in FIG. 9, for receiving the lateral supports of the channel cover upon assembly. It will be appreciated that any complementary configuration of lateral supports and depression may be provided to allow for a stable installation of the cover, and this would be well within the purview of a skilled person in the art. With that in mind, the depressions will have substantially the same height of the height of the lateral support to allow for a snug fit of the cover on the top of the chamber. FIGS. 10A and 10B show channel cover 710 installed on top of a leaching chamber 110, with 10B also showing two leaching chambers connected together. FIG. 11 also shows channel cover 710 installed on top of a leaching chamber 110, specifically illustrating an embodiment comprising a filtration bloc 330 and illustrating water flow upon use.

FIG. 15A, FIG. 15B, FIG. 15C and FIG. 15D show views of an alternate cover and assembly for a leaching chamber according to exemplary embodiments of the application. In this embodiment, the cover 1500 is provided with at least one leg 1510, which is complementary to at least one notch 1520 (see FIG. 15C and FIG. 15.D) provided at the top of the leaching chamber to allow for a snug fit of the cover on the top of the chamber. In this embodiment, the cover is received on one leaching chamber and the complementary notch is provided on an adjacent chamber such that assembly of the leg and notch contributes to the fastening and retention of the two leaching chambers together.

In some embodiments, the sidewalls of the leaching chamber are corrugated on their length, to provide strength against deformation caused by lateral and vertical loads, alternating with depressions and sidewalls or peaks and valleys, portions of which may be perforated either by holes or slots to allow for lateral water drainage, and possible ribs. In some embodiments, the sidewalls are corrugated comprising alternating peaks and valleys extending from said top wall and downwardly towards the bottom end of each of said sidewalls.

In some embodiments, the leaching chamber of the application is made of acrylonitrile butadiene styrene (ABS), polyethylene (PE), polypropylene (PP), fiberglass, or combinations thereof.

In some embodiments, the leaching chamber of the application is made by thermoforming, injection, rotomolding, blow molding, or any suitable method known in the art.

In some embodiments, provided is a leaching assembly comprising a plurality of leaching chambers of the present application consecutively connected to form a continuous distribution channel and internal chamber. In some embodiments, a leaching assembly comprises from 2 to 25 consecutive leaching chambers. In some embodiments, a leaching assembly comprise from 4 to 22 consecutive leaching chambers. In some embodiments, a leaching assembly comprise from 5 to 20 consecutive leaching chambers. In some embodiments, a leaching assembly has an assembled length of about 1 meter to about 30 meters. In some embodiments, a leaching assembly has an assembled length of about 2 meters to about 24 meters. In some embodiments, a leaching assembly has an assembled length of about 4 meters to about 18 meters.

The present application further provides kits comprising the leaching chambers of the application.

In some embodiments, a kit for receiving, collecting and dispersing water is provided, the kit comprising at least one leaching chamber of the present application; at least one structural tab for securing opposing sidewalls of the leaching chamber for preventing lateral deformation of said sidewalls; optionally at least one channel cover; and instructions of installation.

In some embodiments, a leaching chamber kit is provided, comprising: the leaching chamber comprising a single unitary piece defining an open-bottom internal chamber and a distribution channel; a structural tab for securing opposing sidewalls of the leaching chamber for preventing lateral deformation of said sidewalls; a channel cover configured for covering the distribution channel and for preventing deformation of the leaching chamber; and instructions of installation.

In some embodiments, a leaching chamber kit is provided, comprising: a plurality of stacked leaching chamber sections, each section comprising a single unitary piece defining an open-bottom internal chamber and an open-top distribution channel; a plurality of channel covers comprising lateral supports, each channel cover being configured for covering the distribution channel of one of the leaching chamber sections and for preventing deformation of the leaching chamber; and instructions of installation.

In some embodiments, a kit for preparing a drain field is provided, the kit comprising a stack of a plurality of leaching chambers of the present application; a plurality of structural tabs; a plurality of channel covers; and instructions of installation.

III. Methods and Uses of the Application

The present application also includes a method for receiving, collecting and dispersing water, the method comprising; disposing at least one leaching chamber of the present application in a water receiving area and connecting at least one structural tab to said leaching chamber, wherein a first end of said structural tab is connected to a bottom end of one of the two sidewalls, said structural tab extending perpendicularly through the internal chamber and having a second end connected to a bottom end of the other of the two sidewalls; optionally installing a channel cover; burying the at least one leaching chamber.

The present application further includes a method for preparing a drain field, the method comprising disposing at least one leaching chamber on a filtration media of the drain field, for receiving, collecting and dispersing water and connecting at least one structural tab to said leaching chamber, wherein a first end of said structural tab is connected to a bottom end of one of the two sidewalls, said structural tab extending perpendicularly through the internal chamber and having a second end connected to a bottom end of the other of the two sidewalls; optionally installing a channel cover; burying the at least one leaching chamber.

In some embodiments, the filtration media is selected from a sand bed, biochar, crushed rubber recycled glass, zeolite, native soil or the like, and any combination thereof.

Also included is a method of installing a leaching chamber, the method comprising disposing on a surface the leaching chamber comprising a single unitary piece defining an open-bottom internal chamber and an open-top distribution channel; securing sidewalls of the leaching chamber for preventing lateral deformation of said sidewalls; and covering the distribution channel with a channel cover comprising lateral supports for preventing deformation of the leaching chamber.

In some embodiments, securing the sidewalls is carried out with at least one structural tab. In some embodiments, securing the sidewalls comprises connecting said at least one structural tab to said leaching chamber, wherein a first end of said structural tab is connected to a bottom end of one of the two sidewalls, said structural tab extending perpendicularly through the internal chamber and having a second end connected to a bottom end of the other of the two sidewalls. In some embodiments, the at least one structural tab is formed within the single unitary piece. In some embodiments, the at least one structural tab is a separate piece removably fixable to the bottom end of each of the opposing sidewalls. In some embodiments, at least two structural tabs are provided at each end of the leaching chamber.

Also included is a use of a leaching chamber, a leaching assembly or a kit of the present application, for receiving, collecting and dispersing water.

Further provided is a use of a leaching chamber, a leaching assembly or a kit of the present application, in a drain field for receiving, collecting and dispersing water.

Also included is a use of a leaching chamber, a leaching assembly or a kit of the present application, for preparing a drain field.

EXAMPLES

The following non-limiting examples are illustrative of the present application.

General Methods

Figure 12:
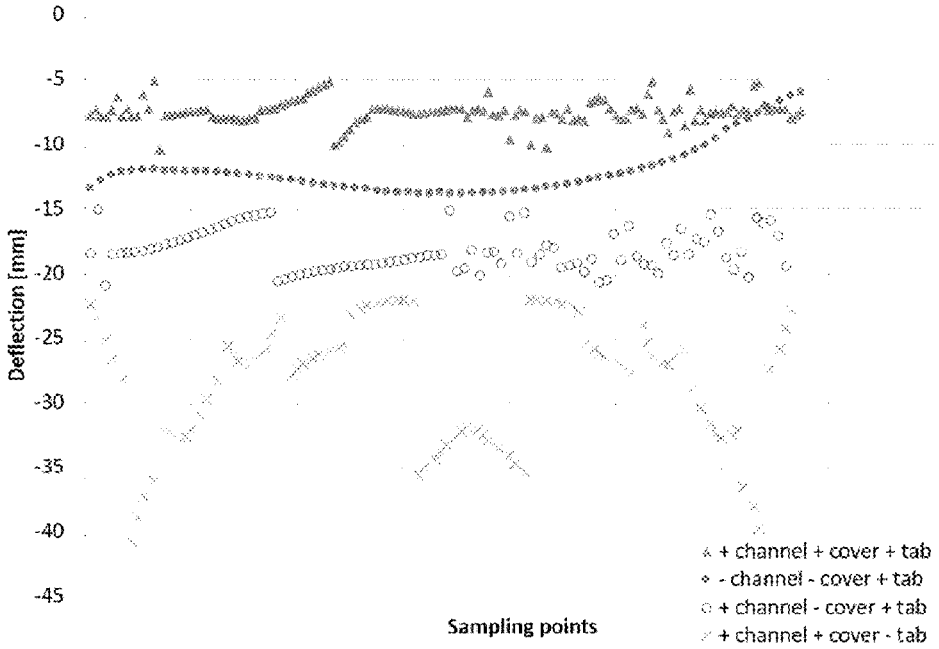
FIG. 12 is a graph of deflection on sampling points of leaching chambers, according to exemplary embodiments of the application.

Finite element analyses (FEA) were performed to demonstrate the negative impact of integrating a distribution channel on the top wall of the leaching chamber, the positive counteraction of the channel's cover and the influence of one structural tab on the chamber's resistance to deformation. A vertical force of 9800 N (Newtons) was applied on the top wall whereas 2000 N were applied horizontally on the sidewalls to represent the physical constraints a typical backfill would provide to a chamber. FIG. 12 is a graph representing the results, in which the comparison criterion is the ordinate displacement of the crest line in millimeters. The sampling points, on the abscissa, corresponds to the nodes of the FEA mesh, positioned along the center of the chamber's top wall.

Triangles correspond to the deformation of an embodiment of this application, for a leaching chamber having an open top distribution channel and its cover and a structural tab located at one end, as illustrated on FIGS. 10A and 10B. Filled circles correspond to the deformation for a similar chamber without any distribution channel. Empty circles correspond to the deformation for a leaching chamber having an open top distribution channel, having a structural tab but without the cover. Finally, the Xs correspond to the deformation for a leaching chamber having an open top channel and its cover, but without any structural tab. Without being bound to theory, it has been clearly demonstrated that the addition of a distribution channel weakens the chamber (see empty circles and Xs compared to filled circles) but the structural tab compensates for this weakness by strengthening the chamber, since chambers featuring that component show much less deformation. The addition of a cover acting as a keystone also increases the mechanical resistance of the chamber, being less deformed under constraints than a regular chamber without the cover (see triangles compared to filled circles). As such, it has been demonstrated that the inclusion of an integrated distribution channel may be compensated by additional structures for improving resistance, such as one or many structural tabs, fastening means between consecutive leaching chambers and covers including lateral supports.

The invention claimed is:

1. A leaching chamber for collecting and dispersing water, comprising:

an elongated body having a top wall, two opposing sidewalls extending downwardly from each side of the top wall, said elongated body defining an internal chamber for collecting the water and having an open bottom to allow for discharge of the water; and a distribution channel formed integrally within the top wall of the elongated body and configured for receiving and dispersing the water, said distribution channel being formed longitudinally and being perforated along the elongated body for draining the water into the internal chamber, wherein said elongated body and said distribution channel form a single unitary piece;

wherein said distribution channel has an open top and said leaching chamber further comprises a channel cover for protecting said distribution channel from backfill when buried and said distribution channel comprises depressions formed on an upper portion of each side of the distribution channel for receiving the channel cover.

2. The leaching chamber of claim 1, further comprising at least one structural tab having a first end connected to a bottom end of one of the two sidewalls, said at least one structural tab extending perpendicularly to the longitudinal axis of the internal chamber and having a second end connected to a bottom end of the other of the two sidewalls, wherein said at least one structural tab is configured to retain the sidewalls and prevent lateral deformation.

3. The leaching chamber of claim 2, wherein said at least one structural tab is formed within the single unitary piece.

4. The leaching chamber of claim 2, wherein said at least one structural tab is a separate piece removably fixable to the bottom end of each of the opposing sidewalls.

5. The leaching chamber of claim 2, wherein at least two structural tabs are provided, one at each end of the elongated body.

6. The leaching chamber of claim 1, further comprising sitting ends at the bottom end of each opposing sidewalls and extending outwardly from the elongated body.

7. The leaching chamber of claim 6, wherein an angle formed between the sidewalls and the sitting ends is from about 90° to about 135°.

8. The leaching chamber of claim 1, wherein the elongated body has a height to width ratio of about 1:1 to about 1:3.

9. The leaching chamber of claim 1, wherein an angle formed between the top wall and the sidewalls is from about 90° to about 135°.

10. The leaching chamber of claim 1, wherein said distribution channel is perforated at a bottom, at lateral sides or a combination thereof.

11. The leaching chamber of claim 10, wherein lateral perforations may extend at an angle from about 0 degrees to about 80 degrees from a center of the bottom along the lateral sides of the channel.

12. The leaching chamber of claim 1, wherein the distribution channel is perforated in a ratio of about 1 perforation per meter to about 24 perforations per meter.

13. The leaching chamber of claim 1, wherein the channel cover comprises lateral supports to be received within the depressions.

14. The leaching chamber of claim 13, wherein the lateral supports are present on about 25% to about 100% of the length of the cover.

15. The leaching chamber of claim 13, wherein the height of the lateral supports is about 5% to about 50% of the height of the distribution channel.

16. The leaching chamber of claim 1, wherein said sidewalls are corrugated comprising alternating peaks and valleys extending from said top wall and downwardly towards the bottom end of each of said sidewalls.

17. The leaching chamber of claim 1, further comprising fastening means at each end of said elongated body for securing multiple leaching chambers consecutively.

18. The leaching chamber of claim 17, wherein said fastening means on one end of a leaching chamber is complementary to fastening means on one end of a second leaching chamber.

19. The leaching chamber of claim 1, wherein said elongated body has a substantially arch-shaped cross-section.

20. The leaching chamber of claim 1, configured to be stackable with a plurality of said leaching chambers.

* * * * *